US010369421B2

(12) United States Patent
Kessler et al.

(10) Patent No.: US 10,369,421 B2
(45) Date of Patent: Aug. 6, 2019

(54) SPIKED BALL

(71) Applicant: Kessler Corporation, Los Angeles, CA (US)

(72) Inventors: Alexander Kessler, Los Angeles, CA (US); Brian Kessler, Los Angeles, CA (US)

(73) Assignee: KESSLER CORPORATION, Los Angeles, CA (US)

( * ) Notice: Subject to any disclaimer, the term of this patent is extended or adjusted under 35 U.S.C. 154(b) by 69 days.

(21) Appl. No.: 15/598,658

(22) Filed: May 18, 2017

(65) Prior Publication Data

US 2018/0333615 A1 Nov. 22, 2018

(51) Int. Cl.

| | |
|---|---|
| ***A63B 43/00*** | (2006.01) |
| ***A63B 41/08*** | (2006.01) |
| ***F21V 3/02*** | (2006.01) |

(52) U.S. Cl.

CPC ..... *A63B 41/08* (2013.01); *A63B 43/002* (2013.01); *F21V 3/02* (2013.01)

(58) Field of Classification Search

CPC ..... A63B 41/08; A63B 43/002; A63B 43/06; F21V 33/008

See application file for complete search history.

(56) References Cited

U.S. PATENT DOCUMENTS

| | | | | |
|---|---|---|---|---|
| 563,170 | A * | 6/1896 | Haley | A63B 43/002 473/595 |
| 1,185,432 | A * | 5/1916 | Petersen | A63B 37/0003 473/356 |
| D52,500 | S | 9/1918 | Vaile | |
| D179,035 | S | 10/1956 | Roth | |
| 3,580,575 | A * | 5/1971 | Speeth | A63B 43/06 273/138.2 |
| 4,368,684 | A | 1/1983 | Launay | |
| 4,522,396 | A | 6/1985 | Girard et al. | |
| 4,756,529 | A | 7/1988 | Stillinger | |
| D301,161 | S * | 5/1989 | Dunse | D21/707 |

(Continued)

FOREIGN PATENT DOCUMENTS

| | | |
|---|---|---|
| CN | 302405235 | 4/2013 |
| CN | 302727470 | 1/2014 |

(Continued)

OTHER PUBLICATIONS

Great Bur Reed (Sparganium eurycarpum) shown on webpage :http://www.agrecol.com/zoomify.asp?catalogid=225&img=assets/images/store%20images/spaeur%206001.jpg [Accessed Jul. 26, 2018] (Year: 2018) 1-1.

(Continued)

*Primary Examiner* — Steven B Wong

(74) *Attorney, Agent, or Firm* — Browdy and Neimark, P.L.L.C.

(57) ABSTRACT

A spiked ball includes an inflatable ball having an outer surface and a series of protrusions on the outer surface. The protrusion each appear as a tear-dropped shape mass that includes a base having a relatively flat bottom adhered to the outer surface and a narrow tip extending away from the outer surface. The narrow tip may also appear as a curved tale. The spikes provide a unique tactile feel and a surface for gripping that is different than other balls. The spikes also cause the ball to contact or "grab" the ground to create a unique bounce.

25 Claims, 7 Drawing Sheets

(56) References Cited

U.S. PATENT DOCUMENTS

| | | | | | |
|---|---|---|---|---|---|
| 4,836,552 | A | | 6/1989 | Puckett et al. | |
| 4,962,926 | A | * | 10/1990 | Chen | A63B 43/00 446/490 |
| 4,991,841 | A | * | 2/1991 | Paranto | A63B 43/00 446/490 |
| 5,028,053 | A | * | 7/1991 | Leopold | A63B 43/002 473/473 |
| 5,054,778 | A | * | 10/1991 | Maleyko | A63B 43/06 273/DIG. 8 |
| 5,131,665 | A | * | 7/1992 | Myers | A63B 43/002 473/569 |
| 5,228,686 | A | * | 7/1993 | Maleyko | A63B 43/06 273/DIG. 8 |
| 5,433,438 | A | | 7/1995 | Gilman | |
| 5,639,076 | A | * | 6/1997 | Cmiel | A63B 43/06 362/806 |
| 5,725,445 | A | * | 3/1998 | Kennedy | A63B 43/06 473/570 |
| D393,671 | S | * | 4/1998 | Honaker | D21/707 |
| D396,904 | S | | 8/1998 | Leu | |
| D401,365 | S | | 11/1998 | Liu | |
| D406,545 | S | * | 3/1999 | Deginther | D11/121 |
| D441,815 | S | | 5/2001 | Murphy | |
| D462,131 | S | | 8/2002 | Huang et al. | |
| 6,485,378 | B1 | | 11/2002 | Boehm | |
| 6,527,616 | B1 | * | 3/2003 | Li | A63B 43/005 446/267 |
| 6,575,855 | B1 | * | 6/2003 | Buzak | A63B 43/06 473/569 |
| 6,645,101 | B1 | * | 11/2003 | Wong | A63B 43/00 473/594 |
| 7,014,581 | B2 | * | 3/2006 | Ng | A63B 41/00 473/570 |
| D535,341 | S | * | 1/2007 | Chernick | D21/398 |
| D536,754 | S | | 2/2007 | Chernick et al. | |
| D537,131 | S | | 2/2007 | Chernick et al. | |
| D540,896 | S | * | 4/2007 | Chernick | D21/398 |
| D551,307 | S | * | 9/2007 | Chernick | D21/707 |
| D561,277 | S | * | 2/2008 | Chernick | D21/398 |
| D568,424 | S | | 5/2008 | Nelson et al. | |
| 7,413,524 | B1 | * | 8/2008 | Bibby | A63B 43/002 473/595 |
| D581,765 | S | * | 12/2008 | Lane | D21/707 |
| D583,421 | S | | 12/2008 | Slinker | |
| 7,517,324 | B2 | * | 4/2009 | Cohen | A61H 7/001 601/135 |
| D626,610 | S | | 11/2010 | Grimm | |
| D637,667 | S | | 5/2011 | Lin et al. | |
| D650,874 | S | | 12/2011 | Williams | |
| D657,011 | S | | 4/2012 | Lederman et al. | |
| D667,515 | S | | 9/2012 | Wang | |
| D672,398 | S | | 12/2012 | Kondou et al. | |
| 8,579,741 | B2 | * | 11/2013 | Heland | A63B 43/002 473/595 |
| D695,371 | S | * | 12/2013 | Hedeen, Jr. | D21/707 |
| D698,878 | S | | 2/2014 | Zhang et al. | |
| 8,727,919 | B1 | * | 5/2014 | Gentile | A63B 43/06 473/570 |
| D706,883 | S | | 6/2014 | Hedeen, Jr. | |
| D738,964 | S | | 9/2015 | Reynolds | |
| D817,562 | S | | 5/2018 | Markham | |
| 2006/0146525 | A1 | * | 7/2006 | Chernick | A63B 43/06 362/196 |
| 2007/0270233 | A1 | * | 11/2007 | Ruston | A63B 37/0003 473/280 |
| 2009/0209374 | A1 | | 8/2009 | Ou | |
| 2011/0265374 | A1 | | 11/2011 | Tompkins, IV | |
| 2014/0272850 | A1 | * | 9/2014 | Knight | G09B 19/00 434/247 |
| 2015/0005683 | A1 | * | 1/2015 | Balducci | A61H 15/00 601/134 |
| 2015/0083052 | A1 | | 3/2015 | Glaser | |
| 2015/0090193 | A1 | * | 4/2015 | Giarrizzo | A01K 15/026 119/709 |
| 2015/0165277 | A1 | | 6/2015 | Ono et al. | |
| 2015/0256126 | A1 | | 9/2015 | Soofer | |

FOREIGN PATENT DOCUMENTS

| | | | | |
|---|---|---|---|---|
| CN | 304468013 | | 1/2018 | |
| EP | 3025767 | A1 * | 6/2016 | A63B 69/0053 |
| FR | 2585255 | A1 * | 1/1987 | A63B 43/002 |
| GB | 509475 | A | 7/1939 | |
| WO | 2014/191294 | | 12/2014 | |

OTHER PUBLICATIONS

Ourian fruit shown on webpage: https:l/i.pinimg .com/736x10c/6a/a6/0c6aa694d91 fdc6e29f84cbd031 d2ed5--extreme-food-exotic-fo j.odpg[Accessed Jul. 26, 2018] (Year: 2018).

Pollen Grains shown on webpage: https:l/c8.alamy.com/comp/AXJ2AJ/pollen-grain-AXJ2A.J.jpg [Accessed Jul. 26, 2018] (Year: 2018).

Sensory Tactile Hairy LED Light Up Smiley Ball; shown on webpage: https://www.sensorytoywarehouse.com/mini-smile-sizzler-electromites [Accessed Sep. 11, 2018] (Year: 2018).

Flashing Ball—Spiky Light Up Firm Rubber Sensory Gadget shown on webpage: https://www.sensorytoywarehouse.com/flashing-spikey-light-up-ball [Accessed Sep. 11, 2018] (Year: 2018).

Large Sensory Tactile Squishy Hairy String Ball shown on webpage: https://www.sensorytoywarehouse.com/ball-furb-puffer [Accessed Sep. 11, 2018] (Year: 2018).

4 Pack of Rainbow UV Spine Balls shown on webpage: https://www.cheapdisabilityaids.co.uk/4-pack-of-rainbow-uv-spine-balls-39911-p.asp [Accessed Sep. 10, 2018] (Year: 2018).

Bobbling Textured Ball shown on webpage: https://www.cheapdisabilityaids.co.uk/bobbling-textured-ball-2138-p.asp [Accessed Sep. 11, 2018] (Year: 2018).

Rubber Spine Balls Rubber Spine Balls—Super Bouncy Sensory UV Tools (Set of 4) shown on webpage: https://www.sensorytoywarehouse.com/super-bounce-uv-spine-ball [Accessed Sep. 14, 2018] (Year: 2018).

Flashing Sensory Ball—Rainbow shown on webpage: https://wvm.sensorytoywarehouse.com/flashing_bobble_ball [Accessed Sep. 11, 2018] (Year: 2018)

Spiky Light Up Ball shown on webpage: https://www.sensorytoywarehouse.com/SMALL-6.5cm-Spiky-textured-Light-Up-Ball[Accessed Sep. 11, 2018] (Year: 2018).

Spiky Massage Ball shown on webpage:https://www.sensorytoywarehouse.com/100mm-porcupine-tactile-massage- ball [Accessed Sep. 11, 2018] (Year: 2018).

UV Sensory Tactile Knitted Ball Rubber Toy shown on webpage: https://www.sensorytoywarehouse.com/uv-knitted-ball [Accessed Sep. 11, 2018] (Year: 2018).

Wholesale 5OPCS Body Piercing Spiked Koosh Ball Tongue Rings shown on webpage: https://www.aliexpress.com/item/Wholesale-50pcs-Body-Piercing-Spiked-Koosh-Ball-Tongue-Rings-New/517310512.html [Accessed Sep. 14, 2018] (Year: 2018).

A confidential (non-public) offer for sale of a product or prototype within the scope of one or more the claims occurred on Mar. 15, 2017.

Spikey Ball, 3" D., https://web.archive.org/web/20151210193028/http://www.jefferspet.com:80/products/spikey-cat-toy-w-bell?via=533884849fa2600f000000f0%2F533884859fa2600f00000104%2F533884879fa2600f00000128>, fig. 2, retrieved on Sep. 25, 2018.

* cited by examiner

SPIKED BALL

TECHNICAL FIELD

The spiked ball relates to balls having an uneven surface or uneven surface layer, more particularly, balls have a non-smooth, tactile surface.

BACKGROUND

Ball games are a popular form of play. Most conventional balls follow specific and standardized guidelines with dull and unexciting designs. The present invention proposes a novel design of the ball to enhance the pleasure of recreational ball games.

SUMMARY

In one general aspect a spiked ball includes an inflatable ball having an outer surface and a series of protrusions on the outer surface. Embodiments may include one or more of the following features. For example the series of protrusions may include a teardrop shaped mass that includes a base having a relatively flat bottom adhered to the outer surface and a narrow tip extending away from the outer surface. The narrow tip may be straight relative to a central axis of the ball or it may have a curve such that it appears more as a tail.

The base of each teardrop shaped mass may be in contact with the base of each adjacent teardrop shaped mass to completely cover the outer surface. Alternatively, the base of each teardrop shaped mass may be a discrete distance from the base of each adjacent teardrop shaped mass thereby exposing portions of the outer surface of the inflatable ball.

Each teardrop shaped mass deposited on the outer surface may be a polymer with elastic properties (elastomer), such as, for example, rubber, silicon rubber, polyisoprene or polybutadiene, polyisobutylene, etc. The inflatable ball may be made from thermoplastic polyurethane, thermoplastic rubber or polyvinyl chloride or other suitable materials.

The series of protrusions may appear as a layer of spikes covering the outer surface. The spikes may have different colors configured as a pattern or design.

The inflatable ball can have a fill valve. As another feature, there may be an illumination device inside the inflatable ball.

The inflatable ball may be spherical, a spheroid or any other suitable shape, such as, for example, an American style football.

In another general aspect, the spiked ball may include a first layer that includes a hollow sphere having a smooth outer surface and a second layer of more than one globule deposited or dropped onto the outer surface of the sphere. Each globule may appear as a tear-drop shaped mass having a relatively flat base and a narrow tip; the base of each tear-drop shaped mass adheres to the smooth outer surface with the narrow tip extending away from the outer surface.

Embodiments may include one or more of the above or following features. For example, the second layer may be a continuous layer completely covering the first layer thereby adding additional structural integrity. There may also be a lighting device inside the first layer.

In still another embodiment, a spiked globe may be used in a decorative lamp, that includes a translucent or transparent sphere having a relatively smooth outer surface and more than one tear-drop shaped spike attached to the outer surface, each spike having a relatively flat base and a narrow tip extending away from the outer surface, an illumination device or light source inside the sphere and an electrical lighting circuit having a power source and a switch, the lighting circuit being electrically connected to the light source to turn it on and off.

Embodiments may include one or more of the above or following features. For example, a base can be attached to the sphere. In addition, the lighting circuit may be enclosed within the base.

BRIEF DESCRIPTION OF THE DRAWINGS

The following drawings show some of the exemplary embodiments of the present invention.

DETAILED DESCRIPTION

Figure 1:
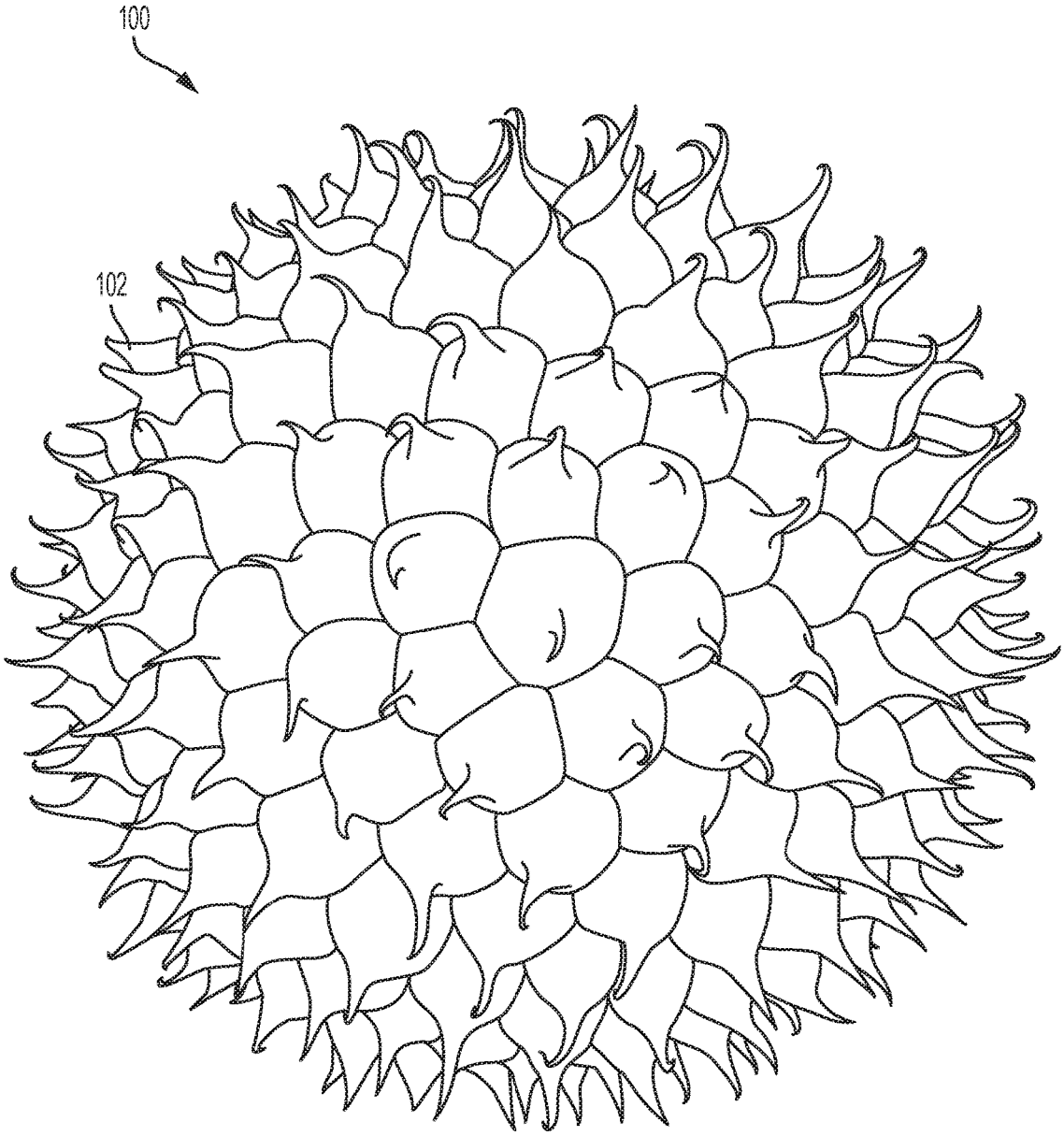
FIG. 1 shows a spiked ball according to the present invention.
Figure 2:
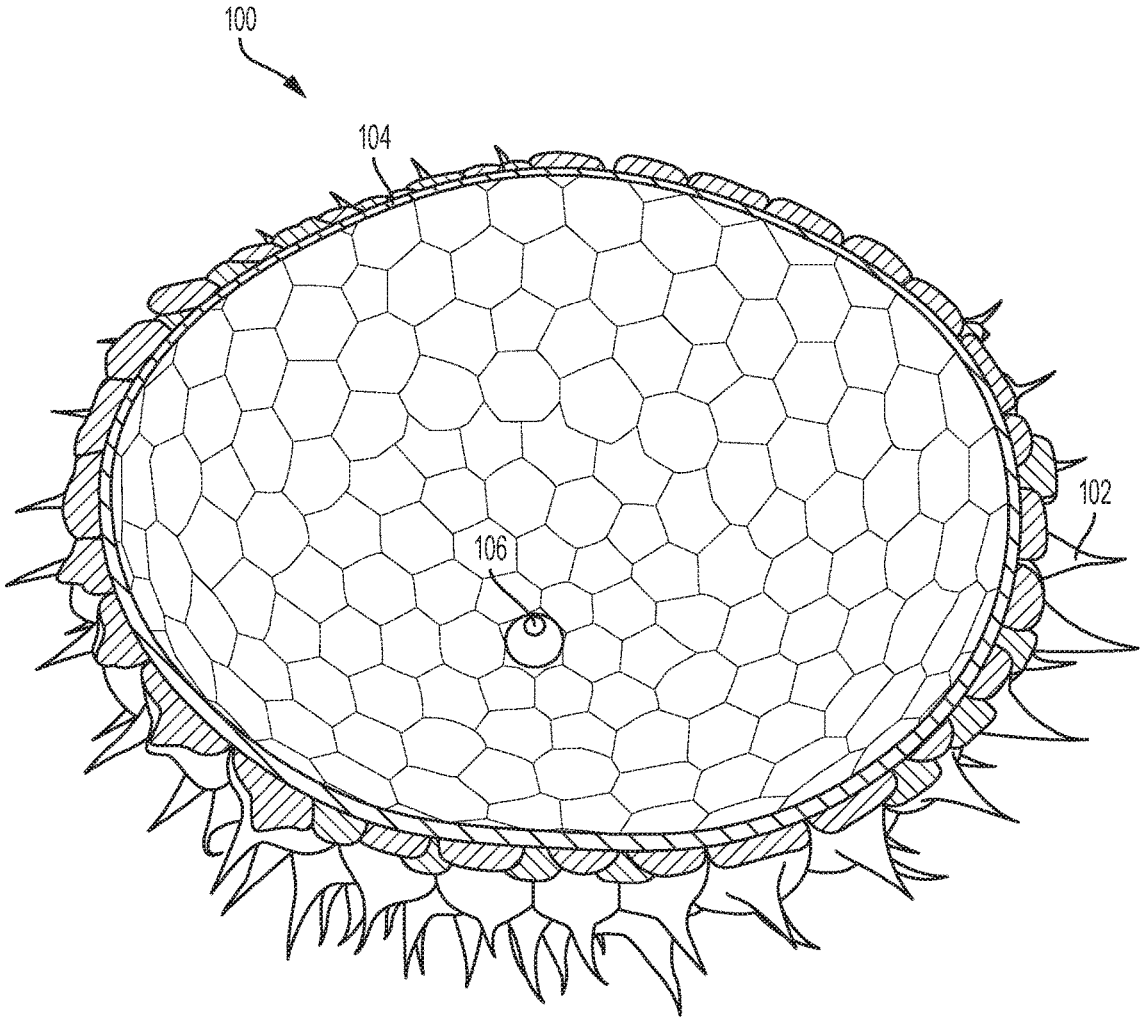
FIG. 2 shows a cross-section perspective view of the ball in FIG. 1.

Referring to FIGS. 1-2, a spiked ball 100 includes a series of spikes 102 covering an inner pressurized ball 104. Hundreds of spikes 102 made of silicon rubber or other elastomers are positioned on the inner ball 104 which is made of plastic or other rubber hybrids, such as, for example, thermoplastic polyurethane, thermoplastic rubber or polyvinyl chloride or other suitable materials. The result is a play ball 100 that does not have a heavy, dangerous hard core and creates a ball 100 that can be used in unique ways that no other ball can do.

The spikes 102 can be made of a softer elastomer such with a high degree of elasticity. This elasticity of the protruding spikes 102 gives the ball 100 a unique tactile feel and provides a surface for gripping that is different than any other ball. The protruding spikes 102 cause the ball 100 to contact or "grab" the ground to create a unique bounce. The spikes 102 may be straight or curved relative to a central axis of the ball 100.

The inner pressurized ball 104 can be made of any inflatable ball structure but typically would not be a balloon or other material that could puncture easily. The inner ball 104 should maintain its own integral structure and pressure to be a product that maintains durability and long life. However, in other embodiments the spikes 102 are a complete layer that provides additional structural integrity.

FIG. 2 is a cut-away or cross section of the ball 100. A fill valve 106 is used to pressurize the ball 100. The ball 104 is made of a transparent material. Thus, the bottom or base 110 of the spikes 102 are visible from the inside of the ball 104. The spikes may be fairly viscous, fluid-like globules when deposited on the ball. Thus, depending on the proximity and pattern of application of the spikes on the ball, the bottom of the spikes can take on random non-circular shapes as the globules settle onto the surface of the ball 104.

Figure 3:
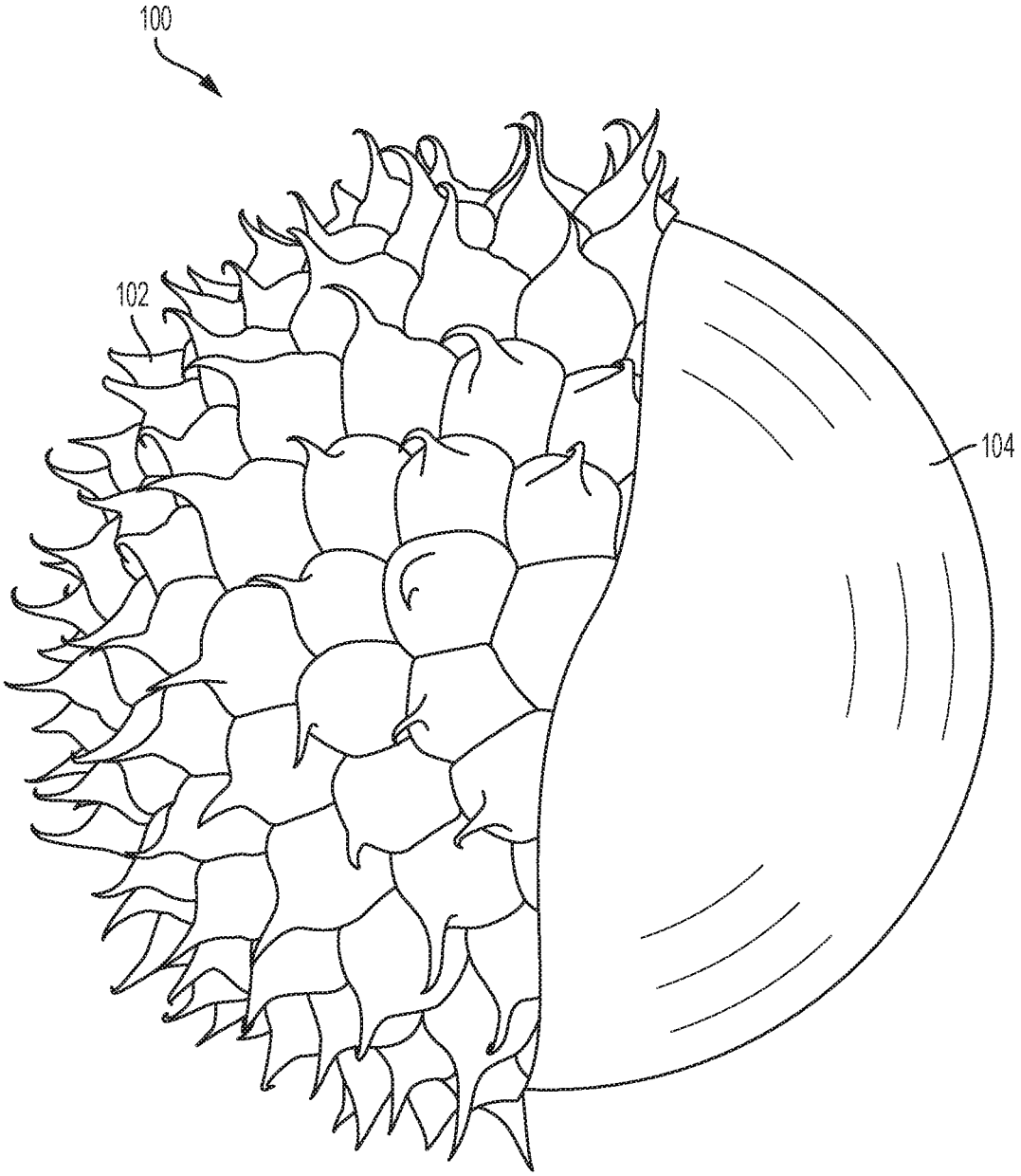
FIG. 3 shows the layers of the ball of FIG. 1.
Figure 4:
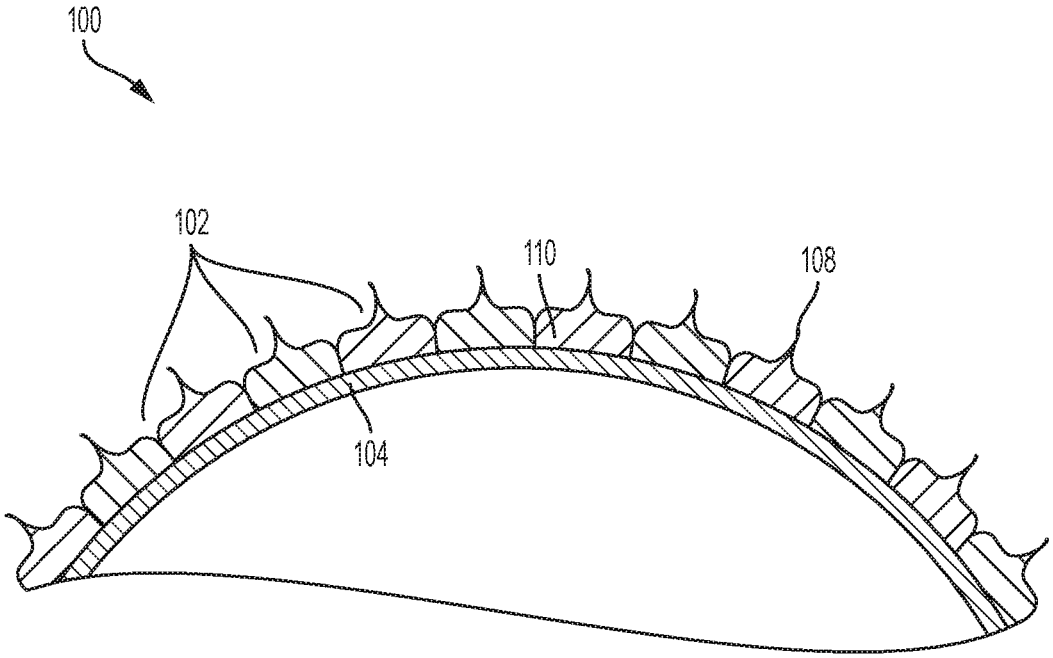
FIG. 4 shows a portion of a cross-section of the ball in FIG. 1.

FIGS. 3 and 4 show an embodiment where the spikes are applied in a continuous layer so as to essentially cover the surface of the inner ball 104. As shown in the more detailed view of FIG. 4, the spikes 102 may have a teardrop shaped with a flat bottom or base 110 adhered to the inner ball 104 and a tail or tip 108 extending away from the center of the spiked ball 100. The base 110 of each tear-dropped mass or spike 102 is in contact with and essentially bonded to the base 110 of each adjacent spike to define an overlapping arrangement. Thus, the inner ball 104 may not be visible and the continuous bonding of adjacent spikes may add some additional structural integrity.

Figure 5:
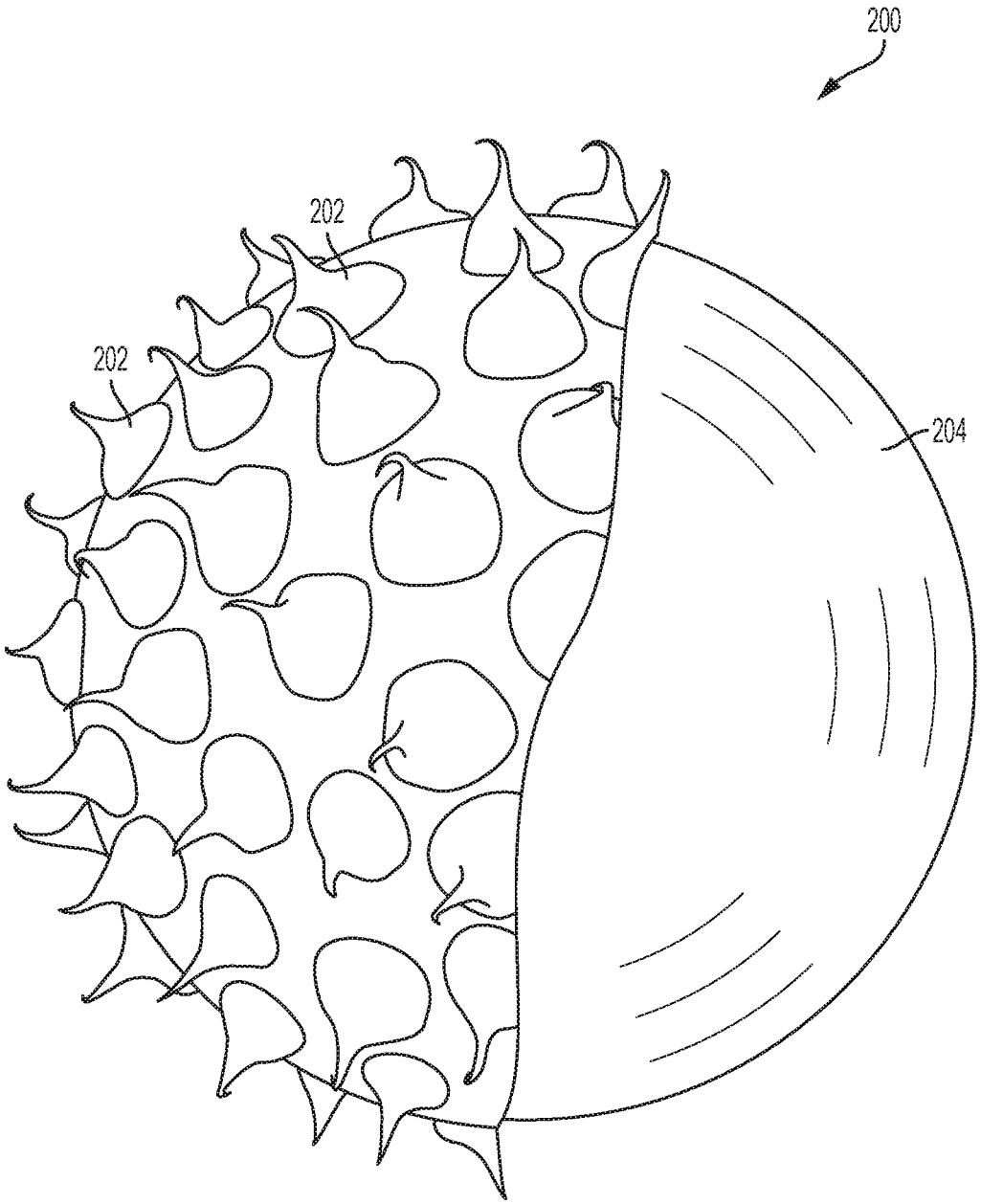
FIG. 5 shows a second embodiment of the spiked ball according to the present invention.

FIG. 5 shows a second embodiment of the ball 200 where a discrete distance is maintained between each spike 202 on an inner pressurized ball 204. Thus, the surface of the ball 204 is visible between the spikes. As shown, the tail of each spike 202 may be curved relative to a central axis of the ball 204.

Figure 6:
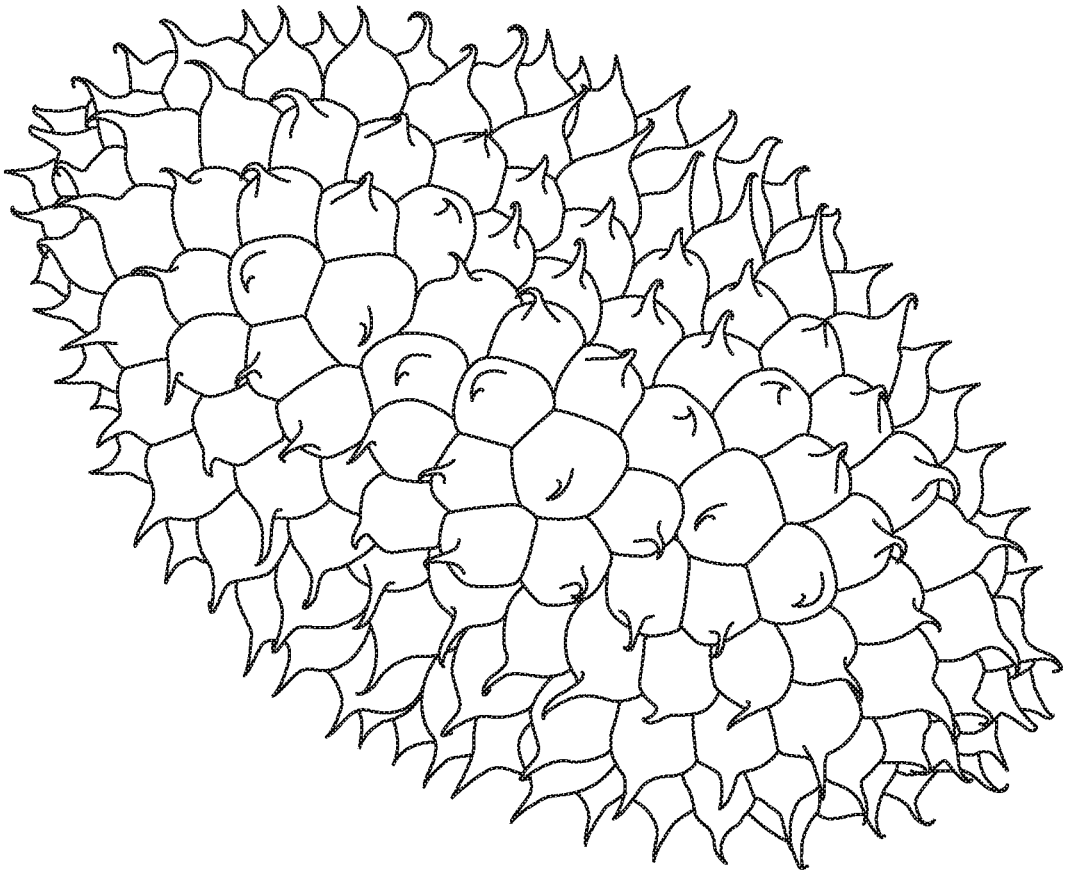
FIG. 6 shows a third embodiment of the spiked ball according to the present invention.

FIG. 6 shows a third embodiment of the spiked ball 300 with a ball that has a shape similar to an American football. Once again, the spikes may be a discrete distance from each other on the pressurized ball 304. The third embodiment is just another example of potential outer shapes which are essentially unlimited.

The manufacturing technique to make the spiked ball can incorporate an automatic or semi-automatic process that applies silicon spikes to the round ball. A "drop" process may be used to produce the spiked ball. In the drop process, a highly viscous elastomer globule is deposited onto the outer surface. The high viscosity globule creates the tail-shaped appearance as it leaves a dispensing device and is deposited onto the ball. The ball is then continuously rotated to deposit each of the spikes in continuous rows or layers as desired.

In addition to a unique tactile surface the spikes allow for a unique visual appearance. Unique patterns can be created using a pixel approach to design. For example, the ball can have stripes, X patterns or triangles. With computer assistance, the spikes may appear as faces, words or other designs may be created.

The ball can be of any size based on the size of the inner ball. Smaller balls may have a solid inner core, but hollow cores are preferred with balls greater than 2 inches in diameter. Otherwise, the additional weight could cause a potentially dangerous impact with a person or could cause damage to another object.

Figure 7:
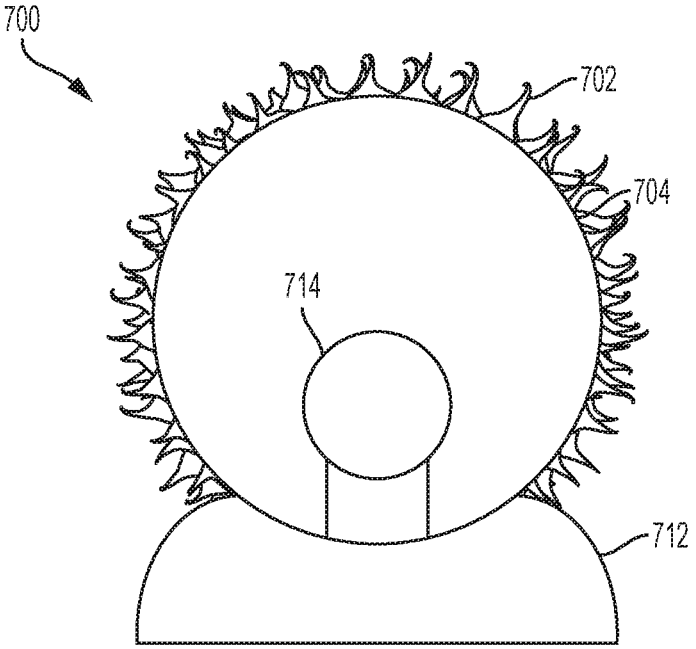
FIG. 7 shows a cross-sectional view of a fourth embodiment of a spiked globe used as a lamp.

FIG. 7, the spiked design can be used for a lamp 700, such as, for example, a night light. The lamp 700 includes a base 712, a globe 704 covered with spikes 702, and a light source 714 inside the globe. The light source may be incandescent, LED or other types of illumination. For a night light application, typically the light source 714 would be low wattage.

Figure 8:
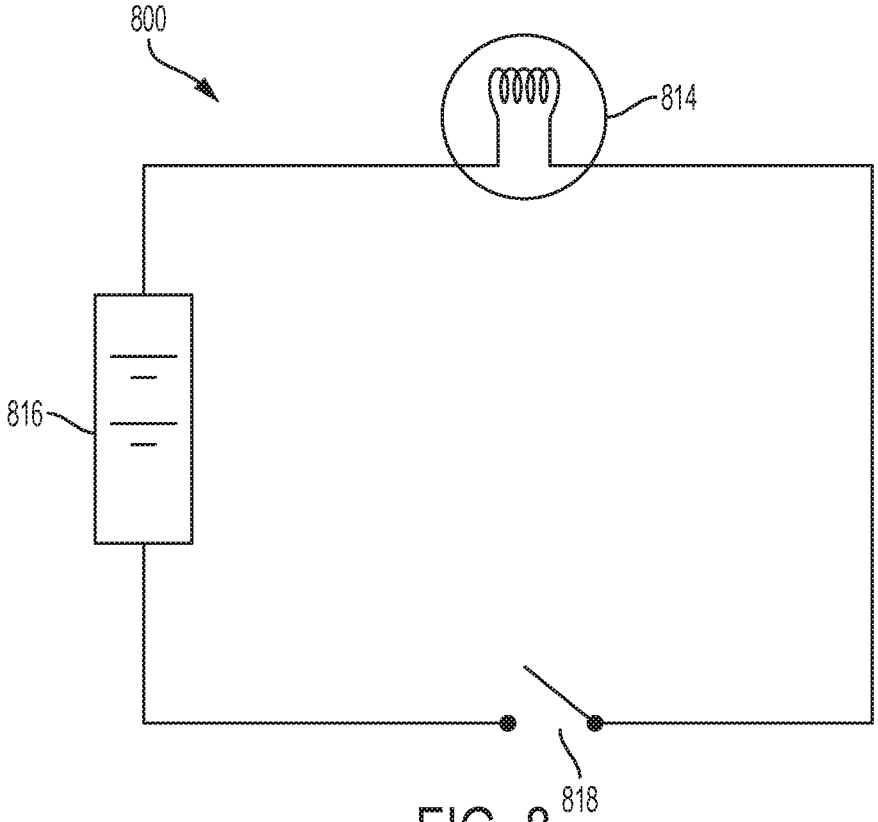
FIG. 8 shows a lighting circuit for the lamp shown in FIG. 7.

FIG. 8 shows an illumination or electrical lighting circuit 800 for the lamp 700. The circuit 800 includes a battery 816 connected to the light source 814 by a switch. The circuit 800 uses a battery 816; however, other sources of power may be used such as a plug into 112 volt alternating current house power with a voltage reduction transformer and a rectifier circuit.

The electrical (illumination) circuit may be in the base 712 of the lamp. In another embodiment, an electrical power circuit is enclosed within an inflated spiked ball. The power circuit has a motion sensor such that the light source is only illuminated when the ball receives an impact or is otherwise moved or in motion. In this embodiment, the circuitry can be made extremely durable so that the ball can be bounced or thrown without damage.

Numerous characteristics and advantages of the present invention have been set forth in the foregoing description, together with details of the structure and function of the invention. However, the disclosure is illustrative only, and changes may be made in details, especially in matters of shape, size, and arrangement or addition of materials that are understood to be within the scope of the invention.

The invention claimed is:

1. A ball, comprising:

an inner ball having an outer surface; and a plurality of protrusions on the outer surface;

wherein each protrusion comprises a generally teardrop shaved mass deposited on the outer surface as a liquid elastomer globule;

each generally teardrop shaped mass includes a base in contact with the outer surface; and each generally teardrop shaped mass deposited on the outer surface partly overlaps with the base of each adjacent teardrop shaped mass to form the substantially continuous layer on at least a portion of the outer surface of the inner ball.

2. The ball of claim 1, wherein each teardrop shaped mass includes a narrow tip that extends from the base in a direction away from the outer surface.

3. The ball of claim 1, wherein each generally teardrop shaped mass comprises an elastomer globule deposited on the outer surface.

4. The ball of claim 3, wherein the elastomer globule comprises silicon rubber.

5. The ball of claim 1, wherein the inner ball comprises rubber, thermoplastic polyurethane, thermoplastic rubber or polyvinyl chloride.

6. The ball of claim 1, wherein the plurality of protrusions comprises different colors configured as a pattern or design.

7. The ball of claim 1, wherein the inner ball comprises an inflatable ball with a fill valve.

8. The ball of claim 1, wherein the inner ball comprises a spherical ball.

9. The ball of claim 1, wherein the inner ball comprises a spheroid shape.

10. The ball of claim 2, wherein the narrow tip of each teardrop shaped mass comprises a narrow tail extending away from the outer surface wherein the tail curves relative to a central axis of the ball.

11. A ball, comprising:

a sphere having a relatively smooth outer surface; and a layer of a plurality of teardrop shaped masses, each teardrop shaped mass having a semi-rounded base with a relatively flat bottom and a narrow tip, the relatively flat bottom of each teardrop shaped mass being positioned on the outer surface and the narrow tip extending away from the outer surface;

wherein the layer of teardrop shaped masses comprise liquid elastomer globules deposited on the outer surface such that at least a portion of the base of each adjacent elastomer globule overlays with each adjacent elastomer globule to bond in a substantially continuous layer on at least a portion of the outer surface.

12. The ball of claim 11, wherein each narrow tip comprises a tail having a curvature relative to a central radius of the sphere.

13. The ball of claim 11, wherein the sphere comprises an inflatable ball with the relatively smooth outer surface.

14. The ball of claim 11, wherein the sphere comprises a substantially solid core.

15. A toy consisting of a ball with a tactile surface layer, comprising:

an inner ball; and a plurality of elastomer globules around at least a portion of the inner ball, each elastomer globule having a semi-round base with a relatively flat bottom on the inner ball and a narrow tail extending from the base in a direction away from the inner ball;

wherein each narrow tail curves or curls in a random direction relative to a central axis of the inner ball; and wherein bases of adjacent elastomer globules overlap and are bonded to each other to form a substantially continuous layer around at least a portion of the inner ball.

16. The toy of claim 15, wherein the elastomer globules are deposited on the inner ball in a viscous state causing each elastomer globule to have a generally non-uniform shape relative to other elastomer globules.

17. The toy of claim 15, wherein the elastomer globules are deposited on the inner ball in a viscous state causing the tails with random curves as elastomer globule depositing devices are withdrawn.

18. The toy of claim 15, wherein the elastomer globules comprise different colors configured as patterns or designs.

19. The toy of claim 15, wherein the inner ball comprises an inflatable ball.

20. The toy of claim 15, wherein the inner ball comprises a substantially solid ball.

21. A ball capable of being bounced, comprising:

an inner ball comprising solid rubber;

a plurality of elastomer globules deposited on the inner ball in a viscous state thereby causing adjacent globules to partially overlap and settle onto the inner ball in randomly non-circular shapes, wherein each globule includes a semi-round main body with a bottom on the inner ball and a randomly curving tail extending from the main body in a direction away from the inner ball; and wherein a portion of the main body of each globule bonds to portions of main bodies of adjacent globules in a substantially continuous layer.

22. A ball, consisting of:

a substantially solid inner ball having elastic properties; and a plurality of liquid elastomer globules deposited on the inner ball, each elastomer globule having a semi-globular body with a bottom on the inner ball and a tail extending from the body in a direction away from the inner ball, wherein more than one tail includes a degree of curvature relative to a central axis of the inner ball;

wherein a portion of the body of each elastomer globule merges with a portion of the body of adjacent elastomer globules in a substantially continuous layer; and wherein the elastomer globules have generally varying overall shapes with respect to other elastomer globules.

23. The ball of claim 1, wherein the elastomer globules are deposited on the surface of the inner ball when the elastomer globules are in a viscous state causing the elastomer globules to settle onto the surface of the inner ball in randomly non-circular shapes, each globule including a semi-globular body with a relatively flat bottom on the outer surface of the inner ball and a randomly curving tail extending from the body in a direction away from the outer surface of the inner ball;

wherein a portion of the body of each elastomer globule bonds to portions of bodies of adjacent elastomer globules in a substantially continuous layer.

24. The ball of claim 11, wherein the substantially continuous layer of the plurality of teardrop shaped masses conceals the appearance of the sphere.

25. A toy, comprising:

a foam core having a shape with an outer surface;

a plurality of elastomer globules deposited on the outer surface, each elastomer globule including a generally round body with a base in contact with the outer surface and a tail extending from the body in a direction away from the base;

wherein the plurality of elastomer globules are deposited on the outer surface in a viscous state such the body of each elastomer globule partially overlaps with a portion of the body of each adjacent elastomer globule and bond together in a substantially continuous layer over at least a portion of the outer surface.

* * * * *